US006137092A

United States Patent [19]

Colombo et al.

[11] Patent Number: 6,137,092

[45] Date of Patent: Oct. 24, 2000

[54] RESISTANCE HEATING ELEMENT, IN PARTICULAR FOR CLOTHES DRYERS

[75] Inventors: Roberto Colombo; Duilio Capraro, both of San Vendemiano, Italy

[73] Assignee: I.R.C.A S.p.A.-Industria Resistenze Corazzate Affini, San Vendemiano, Italy

[21] Appl. No.: 09/422,728

[22] Filed: Oct. 22, 1999

[30] Foreign Application Priority Data

Oct. 22, 1999 [IT] Italy ..... VE98U0032

[51] Int. Cl.[7] ..... H05B 3/02

[52] U.S. Cl. ..... 219/538; 219/541; 219/548

[58] Field of Search ..... 219/532, 536, 219/537, 538, 541, 542, 548, 552; 338/218, 282, 302, 321; 439/20, 28; 392/347, 350, 379, 380, 382, 383

[56] References Cited

U.S. PATENT DOCUMENTS

| | | | |
|---|---|---|---|
| 2,894,107 | 7/1959 | Lefebvre | 219/538 |
| 3,816,706 | 6/1974 | Meywald | 219/537 |
| 3,835,435 | 9/1974 | Seel | 219/538 |
| 3,950,052 | 4/1976 | Walter et al. | 439/28 |
| 3,956,614 | 5/1976 | Hervert | 219/538 |
| 3,957,331 | 5/1976 | Tantillo et al. | 439/20 |
| 4,079,233 | 3/1978 | Meywald | 219/538 |
| 4,230,933 | 10/1980 | Glucksman et al. | 338/302 |
| 4,857,707 | 8/1989 | Dall | 219/532 |
| 4,877,943 | 10/1989 | Oiwa | 219/538 |
| 5,093,558 | 3/1992 | Blystone et al. | 219/532 |
| 5,134,270 | 7/1992 | Bragg et al. | 219/532 |
| 5,329,098 | 7/1994 | Howard et al. | 219/532 |
| 5,895,597 | 4/1999 | Sherrill | 219/536 |
| 5,910,267 | 6/1999 | Stricker | 219/548 |

*Primary Examiner*—Tu Ba Hoang
*Assistant Examiner*—Fadi H. Dahbour

[57] ABSTRACT

A resistive heating element, in particular for clothes dryers, comprising a substantially rectangular plate of heating resistant dielectric material supported at its ends by two shoulders also of heat-resistant dielectric material and inserted through a resistive wire spiral connected at its ends to conductor cables, characterised in that one end of the plate is freely slidable along a slot provided in the corresponding shoulder.

4 Claims, 1 Drawing Sheet

RESISTANCE HEATING ELEMENT, IN PARTICULAR FOR CLOTHES DRYERS

FIELD OF THE INVENTION

This invention relates to a resistance heating element, in particular for clothes dryers.

DESCRIPTION OF THE PRIOR ART

Resistance heating elements are known consisting substantially of a mica plate with a resistive strip wound about its edges. The strip is rigidly fixed at its ends to a mica support structure.

The ends of the strip are then connected to the conductor cables. However this known system has certain drawbacks, and in particular:

- considerable heating of the mica plate due to the fact that the resistive strip cuts into the plate, which consequently reaches a temperature higher than the maximum allowable working temperature of the plate, which tends to carbonize with time,
- the mica plate can fracture because being fixed at its ends and subject to considerable thermal expansion, it is unable to slide mechanically and hence tends to deform and crack.

An object of the invention is to eliminate these drawbacks by providing a heating element in which stress and fracture are prevented.

A further object of the invention is to provide a heating element of simple and comfortable construction.

BRIEF SUMMARY OF THE INVENTION

These and further objects which will be apparent from the ensuing description are attained according to the invention by a resistance heating element, in particular for clothes dryers, comprising a substantially rectangular plate of heating resistant dielectric material supported at its ends by two shoulders also of heat-resistant dielectric material and inserted through a resistive wire spiral connected at its ends to conductor cables, characterised in that one end of the plate is freely slidable along a slot provided in the corresponding shoulder.

BRIEF DESCRIPTION OF THE DRAWINGS

The invention is described in detail hereinafter with reference to the accompanying drawings, on which.

DESCRIPTION OF THE PREFERRED EMBODIMENTS

Figure 1:
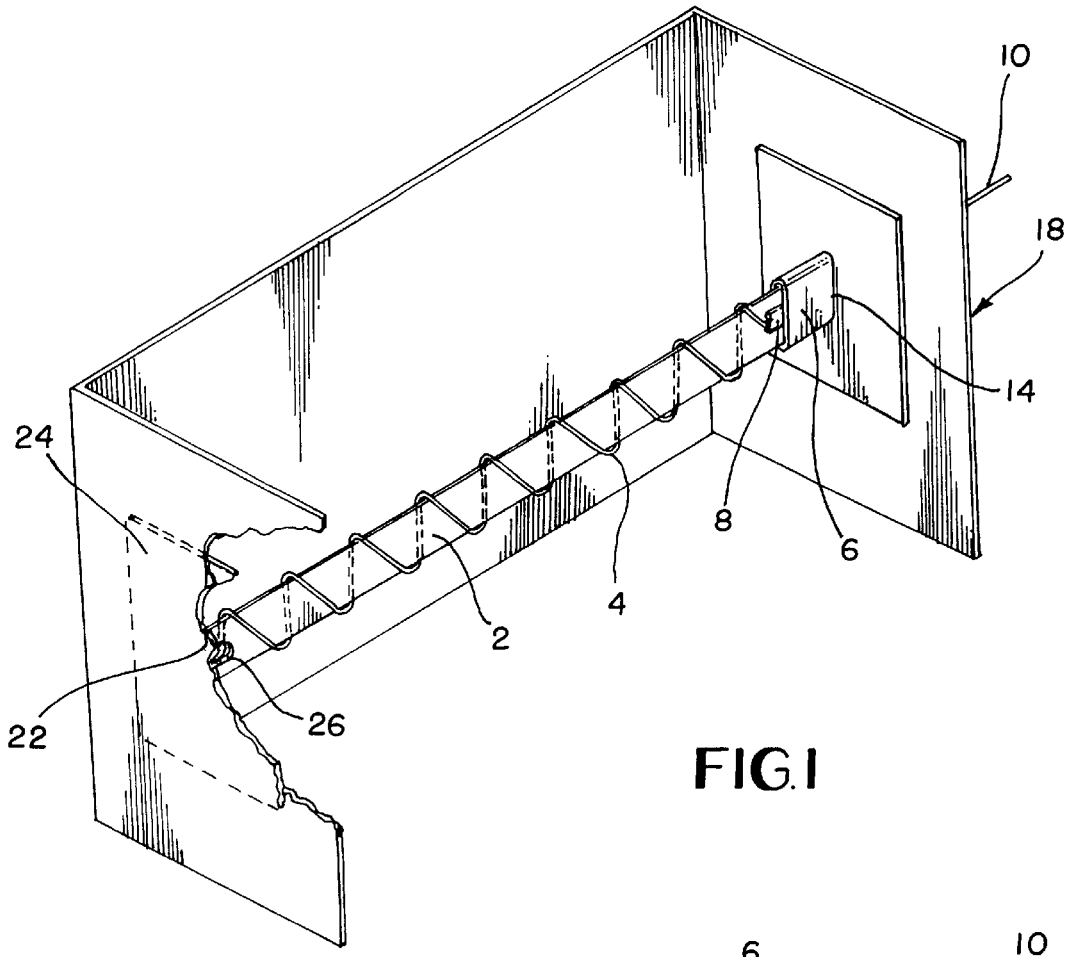
FIG. 1 is an interrupted perspective view of a resistance element according to the invention.
Figure 2:
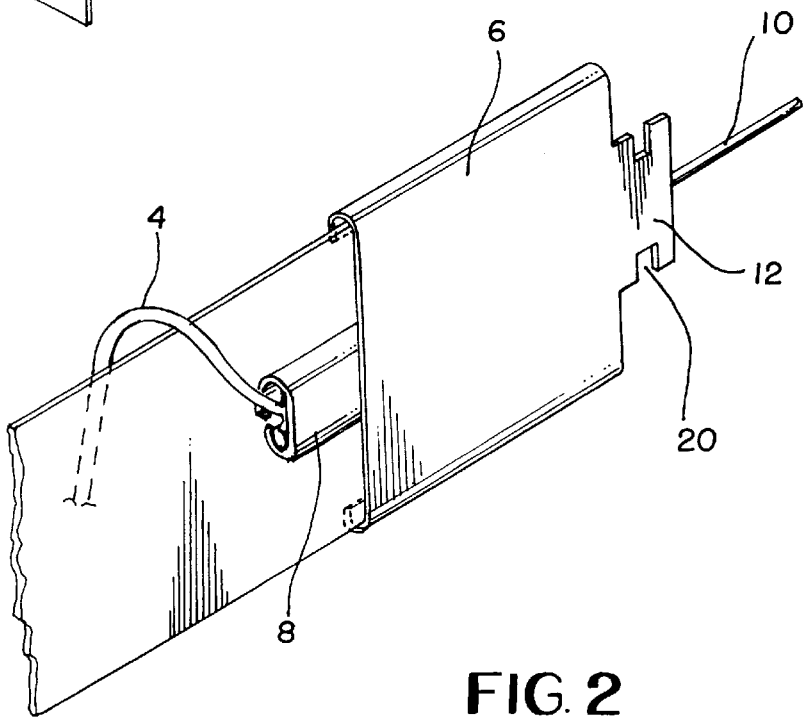
FIG. 2 is an enlarged detailed view of the connector.

As can be seen from the figures, the resistance heating element of the invention comprises substantially a plate 2 of insulating material, preferable mica or phlogopite, inserted through a spiral of resistive wire 4 preferable of Ni—Cr and preferably of 0.5–1.3 mm diameter.

One end of the plate is locked by a substantially C-shaped gripper element 6 from which there extends at one end (towards the plate)a connector 8 for the spiralled wire 4 and for a conductor cable 10, and at the other end a flat appendix 12 to be inserted through a corresponding slot 14 provided in a mica shoulder 16 supported on a metal structure 18.

To ensure very stable fixing, the appendix 12 comprises two notches 20 which enable it to partially rotate about the slot and hence prevent its disengagement.

The fork-shaped other end of the plate 2 is freely inserted through a corresponding slot 22 provided in a mica shoulder 24 supported by the metal structure 18.

The resistive wire 4, which as stated is fixed at one end to the connector 8, is wound substantially loosely about the plate and is inserted through the throat 26 of the fork-shaped end to provide a certain stability with respect to the plate. After insertion in this manner the wire is inserted through the throat of a second plate (not shown on the drawings) to be then wound about it in the aforedescribed manner.

To prevent the spiral undergoing variations in its winding pitch during operation due to the effect of differing temperatures, the spiral is subjected to special stress relieving treatment.

From the aforegoing it is apparent that the resistance element of the invention has numerous advantages, and in particular:

- it prevents overheating of the mica plate in that the wire is only partially wound on it, touching it only at separated points,
- it prevents stress fracture because of the facility of the plate to slide at one end when undergoing heat expansion,
- it enables effective connection between the power cable and the resistive wire by virtue of the connector,
- it presents a uniform spiral pitch because of the stress relieving treatment.

We claim:

1. A resistive heating element, in particular for clothes dryers, comprising a substantially rectangular plate of heating resistant dielectric material supported at its ends by two shoulders also of heat-resistant dielectric material and inserted through a resistive wire spiral connected at its ends to conductor cables, wherein one end of said plate is freely slidable along a slot provided in the corresponding shoulder, wherein at least one end of said plate engages in a connector for connecting the end of said spiraled wire and for connecting a conducting cable, said connector including a C-shaped sleeve slidably supporting the end of said plate and from which there extends at one end an element for clamping the end of said spiraled wire and of said conducting cable, and at the other end a lug non-removably insertable through a corresponding slot provided in said shoulder.

2. A resistance element as claimed in claim 1, wherein said lug comprises two notches enabling it to partially rotate relative to the other end.

3. A resistance element as claimed in claim 1, wherein the end of said plate which freely engages said slot is fork-shaped.

4. A resistance element as claimed in claim 3, wherein an end of said resistance element is passed through a throat of the fork.

* * * * *